US009731296B2

(12) United States Patent
Su et al.

(10) Patent No.: US 9,731,296 B2
(45) Date of Patent: Aug. 15, 2017

(54) BIOCHEMICAL REACTOR

(71) Applicant: GENEREACH BIOTECHNOLOGY CORP., Taichung (TW)

(72) Inventors: Chen Su, Taichung (TW); Hsiao-Fen Chang, Taichung (TW); Pei-Yu Li, Taichung (TW); Yun-Lung Tsai, Taichung (TW); Ching-Ko Lin, Taichung (TW); Wen-Hao Cheng, Taichung (TW)

(73) Assignee: GENEREACH BIOTECHNOLOGY CORP., Taichung (TW)

( * ) Notice: Subject to any disclaimer, the term of this patent is extended or adjusted under 35 U.S.C. 154(b) by 355 days.

(21) Appl. No.: 14/577,655

(22) Filed: Dec. 19, 2014

(65) Prior Publication Data

US 2016/0175843 A1 Jun. 23, 2016

(51) Int. Cl.
*B01L 7/00* (2006.01)

(52) U.S. Cl.
CPC ..... *B01L 7/52* (2013.01); *B01L 2300/1827* (2013.01)

(58) Field of Classification Search
CPC ..... B01L 2300/1827; B01L 2300/1805; B01L 2300/1822; B01L 7/52; B01L 7/54; B01L 7/525
See application file for complete search history.

(56) References Cited

U.S. PATENT DOCUMENTS

2004/0191830 A1* 9/2004 Hwang ..... B01L 7/525 435/6.12
2010/0019782 A1* 1/2010 Watanabe ..... G01N 33/48728 324/692

* cited by examiner

*Primary Examiner* — Nathan Bowers
*Assistant Examiner* — Lydia Edwards
(74) *Attorney, Agent, or Firm* — Muncy, Geissler, Olds & Lowe, P.C.

(57) ABSTRACT

A biochemical reactor includes a temperature control device containing a substrate, a first conductive layer, a second conductive layer, a receiving hole, and a heating element. The substrate has a through hole for accommodating the vessel; the receiving hole is adjacent to the through hole for receiving the heating element; the first conductive layer has a connecting region formed on the wall of the through hole; and two terminals of the heating element are respectively connected electrically to the first and the second conductive layers. As such, the heat generated from the heating element can be transferred to the through hole via the first conductive layer to heat the vessel.

13 Claims, 5 Drawing Sheets

BIOCHEMICAL REACTOR

BACKGROUND OF THE INVENTION

1. Field of the Invention

The present invention relates generally to biochemical reactors and more particularly, to a biochemical reactor which has a simple and lightweight structure, can be assembled and disassembled easily, can be carried and maintained conveniently, and has a reduced manufacturing cost.

2. Description of the Related Art

Many biochemical reactions need to be carried out at a particular temperature through some suitable apparatus. One example is the convective polymerase chain reaction (PCR). In convective PCR system, a heating device is used to heat the bottom of a vessel to establish a temperature gradient in a reactive reagent contained in the vessel, thereby inducing a thermal convection. In this way, the 3 stages of PCR can be carried out sequentially in suitable temperature regions in the vessel.

It is known that commercially available apparatus for performing the convective PCR is bulky and has a complicated structure, such that the manufacturing costs thereof is hard to be reduced and the disassembly process thereof is complicated, resulting in that the maintenance of the conventional apparatus is not easy. Therefore, it is desired to develop a biochemical device which has a simple construction, can be assembled and disassembled conveniently, and can be manufactured with reduced manufacturing costs.

SUMMARY OF THE INVENTION

It is an objective of the present invention to provide a biochemical reactor, which has a simple structure, is relatively small in volume and relatively light in weight; can be carried and maintained conveniently; and can be manufactured with reduced manufacturing costs.

To attain the above-mentioned objectives, the present invention provides a biochemical reactor adapted for insertion of a vessel. The biochemical reactor comprises a first body having a first groove, a second body spaced at a distance above the first body and having a second groove, and a temperature control device including a substrate, a first conductive layer, a second conductive layer, a receiving hole, and a heating element. The substrate has an upper surface, a lower surface opposite to the upper surface, and a through hole extending through the upper surface and the lower surface. The first conductive layer has a lower region formed on a part of the lower surface of the substrate, and a connecting region formed on a wall of the through hole of the substrate and connected to the lower region. The second conductive layer is formed on a part of the upper surface of the substrate and not connected electrically to the first conductive layer. The receiving hole passes through the second conductive layer, the substrate and the lower region of the first conductive layer, and is located adjacent to the through hole. The heating element is disposed in the receiving hole and has two terminals, one of which is connected electrically to the lower region of the first conductive layer and the other one of which is connected electrically to the second conductive layer. The temperature control device is disposed between the first and second bodies in a way that the upper surface of the substrate faces upward or downward. The first groove of the first body, the through hole of the substrate of the temperature control device, and the second groove of the second body are communicated with each other to form a vessel receiving groove for the insertion of the vessel.

According to the present invention, another embodiment of the biochemical reactor adapted for the insertion of a vessel is also provided. The biochemical reactor comprises a first body having a first groove, a second body spaced at a distance above the first body and having a second groove, and a temperature control device including a substrate, a first conductive layer, a second conductive layer, and a heating element. The substrate has an upper surface, a lower surface opposite to the upper surface, and a through hole extending through the upper surface and the lower surface. The first conductive layer has an upper region formed on a part of the upper surface of the substrate, and a connecting region formed on the wall of the through hole of the substrate and connected to the upper region. The second conductive layer is formed on a part of the upper surface of the substrate and not connected electrically to the first conductive layer. The heating element is disposed on the upper surface of the substrate and located adjacent to the through hole, and has two terminals, one of which is connected electrically to the lower region of the first conductive layer and the other one of which is connected electrically to the second conductive layer. The temperature control device is disposed between the first and the second bodies in a way that the upper surface of the substrate faces upward or downward. The first groove of the first body, the through hole of the substrate of the temperature control device, and the second groove of the second body are communicated with each other to form a vessel receiving groove for the insertion of the vessel.

Accordingly, the temperature of a part of the vessel can be maintained at a steady temperature by the temperature control device, such that a biochemical reaction can be carried out in the vessel. In addition, because the temperature control device can be made by a known process of printed circuit board, the configuration thereof is simple and lightweight and the manufacturing cost can be lowered. As a result, in comparison with the conventional biochemical device, the biochemical reactor of the present invention equipped with the temperature control device is relatively light in weight and relatively small in volume; can be assembled and disassembled easily; can be carried and maintained conveniently; and can be produced with reduced manufacturing costs.

DETAILED DESCRIPTION OF EMBODIMENTS

Figure 1:
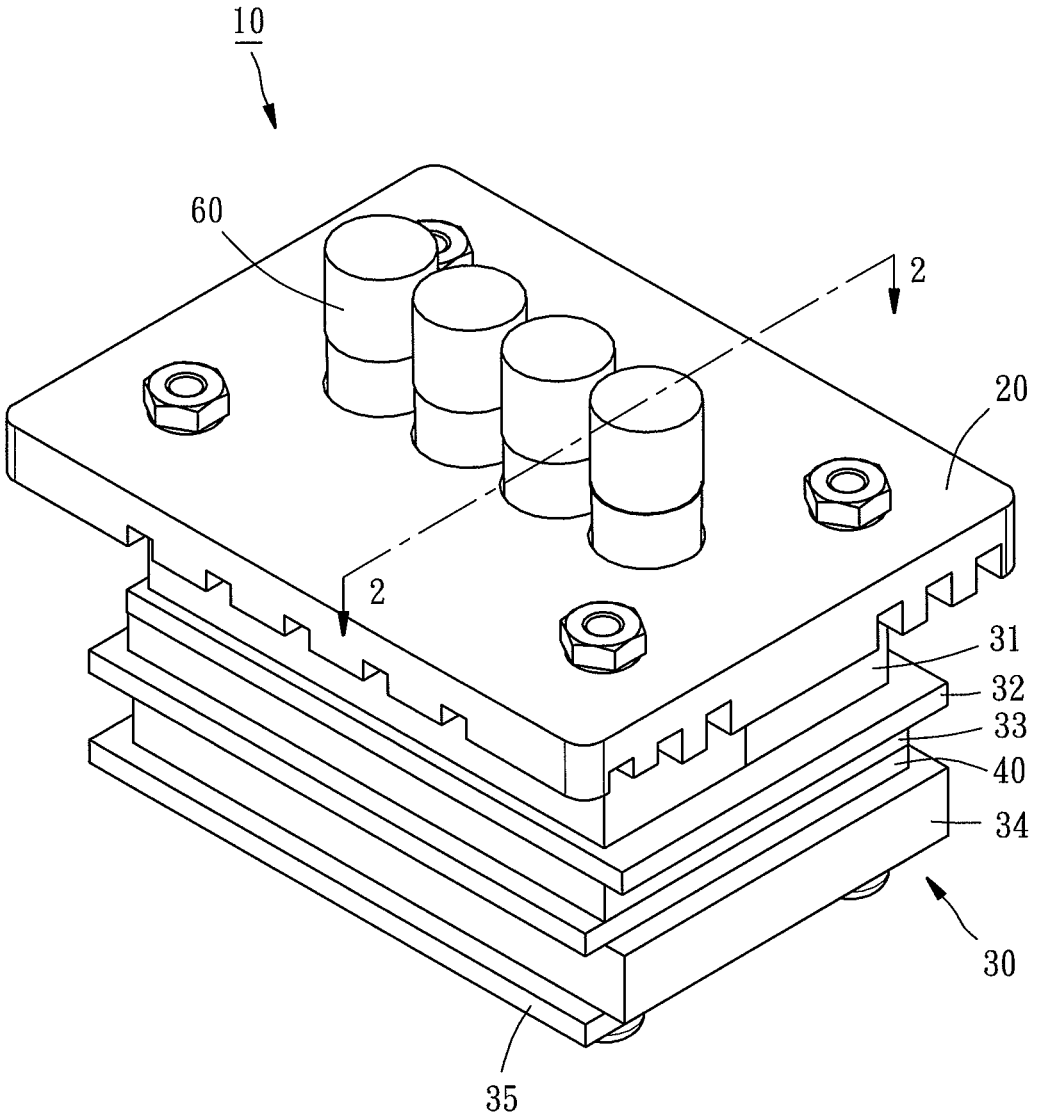
FIG. 1 is a perspective view of a first preferred embodiment of the present invention.
Figure 2:
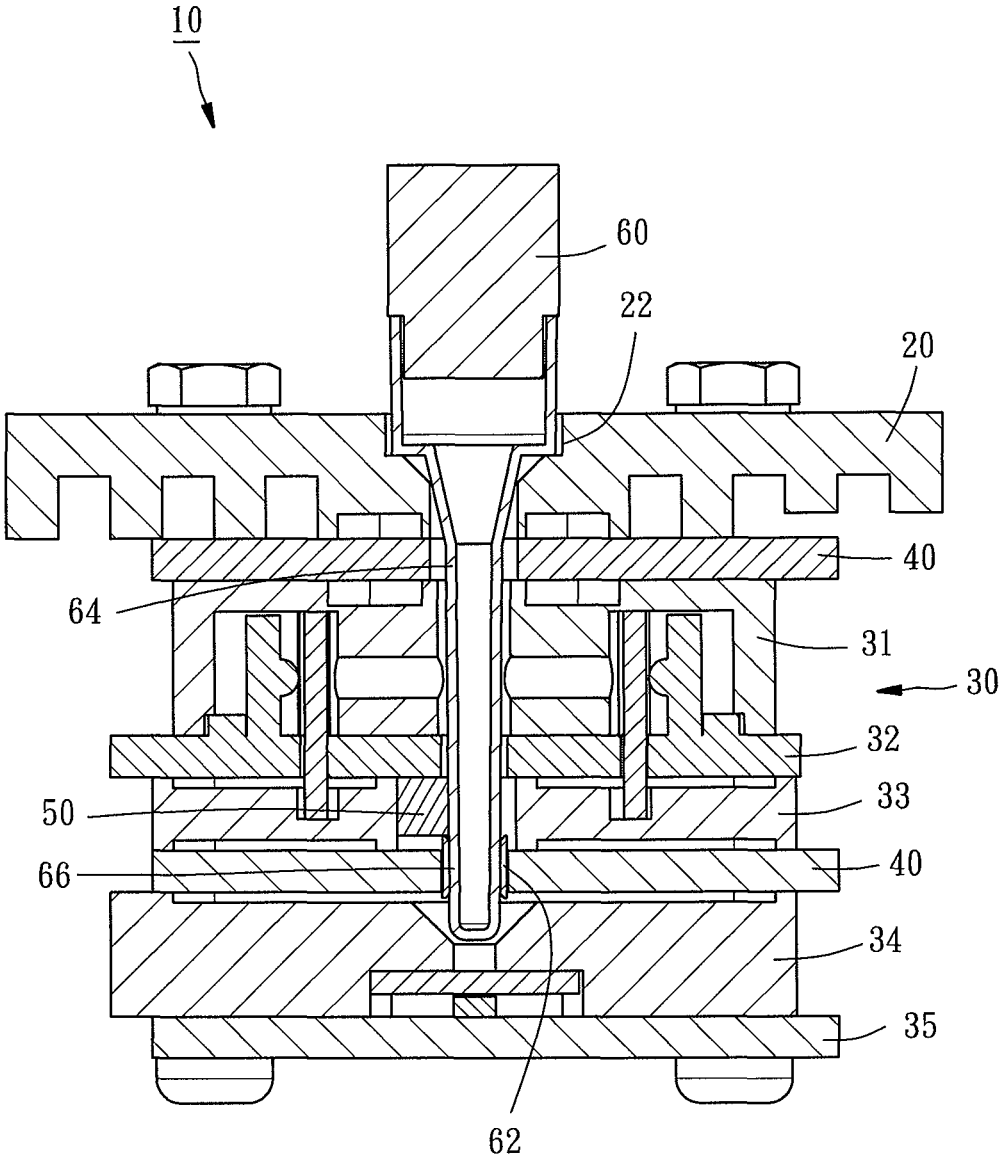
FIG. 2 is a cross-sectional view taken along line 2-2 of FIG. 1.

The structure and the effect of the present invention will become understood more fully from the detailed description given herein below and the accompanying drawings showing the preferred embodiments of the present invention which are given by way of illustration only, and thus are not limitative of the present invention. Referring to FIGS. 1 and 2, a biochemical reactor 10 according to a first embodiment of the present invention is provided. The biochemical reactor 10 is adapted for the insertion of four vessels 60, and hence a specific biochemical reaction such as polymerase chain reaction (PCR) can be performed simultaneously in those vessels 60. The biochemical reactor 10 comprises a vessel holder 20, a detection device 30, two temperature control devices 40, and an elastic member 50. For convenience in explanation and accurate definition in the specification and the appended claims, the spatial terms such as upward, downward, upper, lower, etc. are used with reference to the position of the biochemical reactor shown in FIG. 1.

Figure 3:
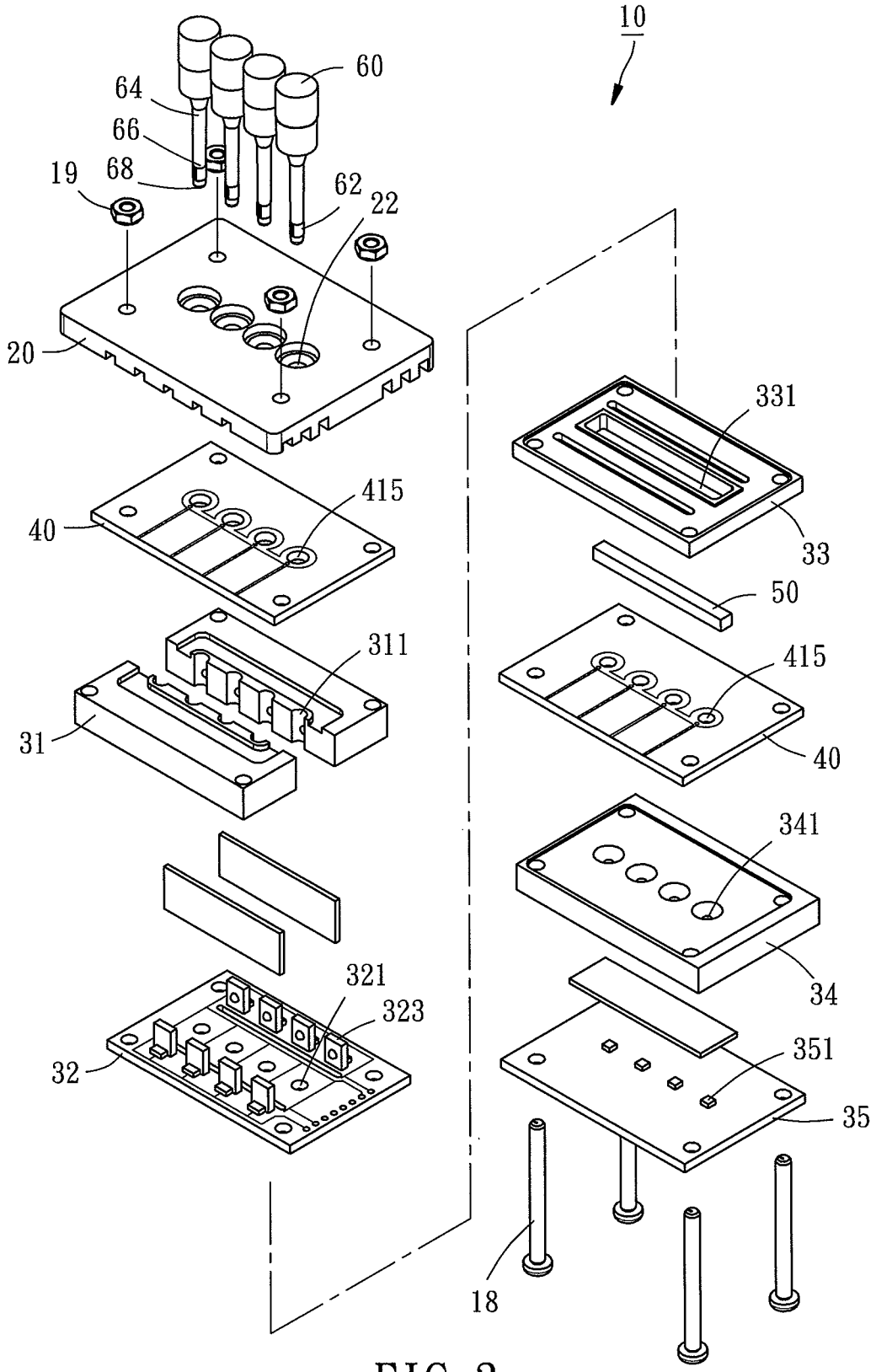
FIG. 3 is an exploded view of the first preferred embodiment of the present invention.

As shown in FIG. 3, the vessel holder 20 is shaped as a plate and has four vessel holes 22 for the insertion of the vessels 60.

The detection device 30 includes a top seat 31, a detection plate 32, a bottom seat 33, a base seat 34, and a lighting circuit board 35. In this embodiment, the top seat 31 is formed by two blocks and has four vertical grooves 311; the detection plate 32 is provided with four through holes 321 respectively corresponding to the vertical grooves 311, and eight sensors 323; the bottom seat 33 has an elongated through groove 331 corresponding to the vertical grooves 311; the base seat 34 has four tapered holes 341 corresponding to the through groove 331; and the lighting circuit board 35 has four light-emitting elements 351. The vertical grooves 311, the through holes 321, the through groove 331, and the tapered holes 341 can line up in a manner to provide space for the insertion of the vessels 60. The lighting circuit board 35 is used to emit lights having specific wavelengths to excite the biochemical reactant contained in each vessel 60 to emit fluorescence, such that the fluorescence can be detected by the sensor 323 of the detection plate 32, resulting in that the progress of the biochemical reaction performed in the vessel 60 can be monitored through the detection device 30.

Figure 4:
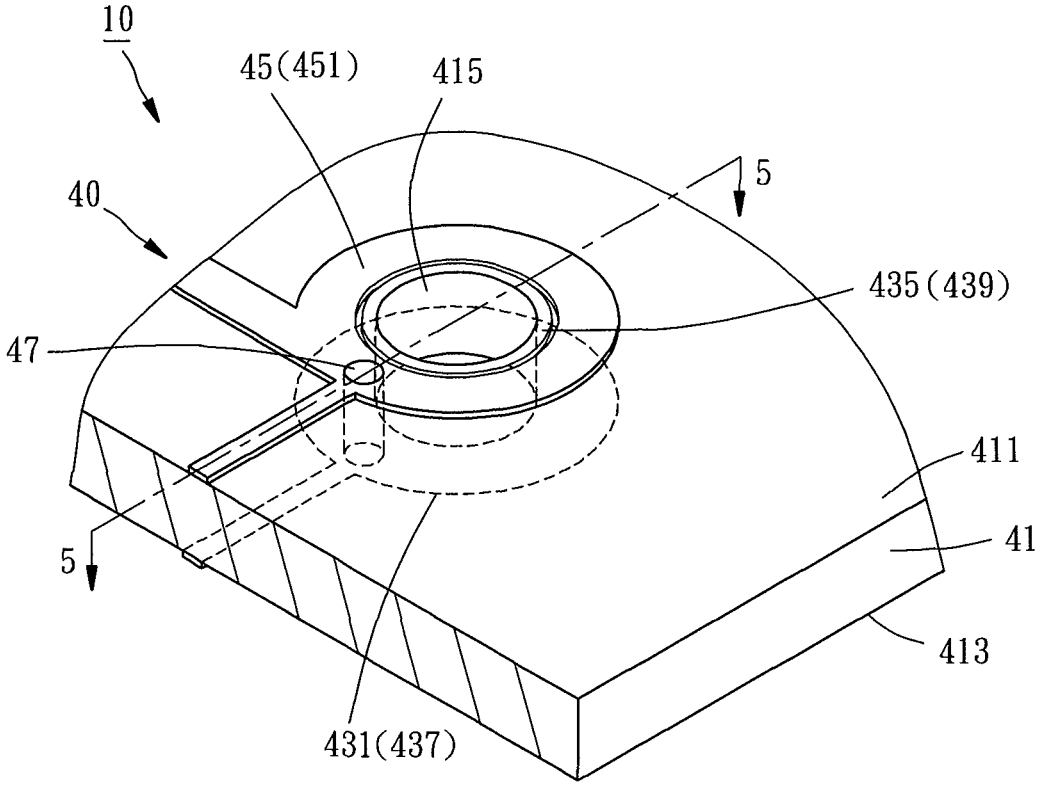
FIG. 4 is a perspective view of a part of a temperature control device of the first preferred embodiment of the present invention.

As shown in FIG. 3, the two temperature control devices 40 are respectively arranged between the vessel holder 20 and the top seat 31, and between the bottom seat 33 and the base seat 34, so as to respectively heat the upper region 64 and the lower region 66 of each vessel 60. Each of the temperature control devices 40 includes a substrate 41, a first conductive layer 43, a second conductive layer 45, a receiving hole 47, and a heating element 49, as shown in FIG. 4.

In this embodiment, the substrate 41 has an upper surface 411, a lower surface 413 opposite to the upper surface 411, and four through holes 415 respectively extending from the upper surface 411 to the lower surface 413 through the substrate 41. The four through holes 415 are in alignment with the four spaces defined by the vessel holes 22, the vertical grooves 311, the through holes 321, the through groove 331, and the tapered holes 341, such that each vessel 60 can be inserted in the biochemical reactor 10. Furthermore, the substrate 41 of the temperature control device 40 may be disposed in the biochemical reactor 10 in a way that the upper surface 411 faces upward or downward.

The first conductive layer 43 of each temperature control device 40 may be made of a material having good electrical conductivity and thermal conductivity properties such as copper or the like. The first conductive layer 43 has a lower region 431 formed on a part of the lower surface 413 of the substrate 41, a connecting region 433 formed on the wall of the through hole 415 of the substrate 41 and connected to the lower region 431, and an upper region 435 formed on a part of the upper surface 411 of the substrate 41 and connected to the connecting region 433. A part of the lower region 431 of the first conductive layer 43 surrounds each through hole 415 to define a ring portion 437, and a part of the upper region 435 of the first conductive layer 43 surrounds each through hole 415 to define a ring portion 439. The connecting region 433 serves to abut an outer periphery of each vessel 60. In another embodiment, a thermal conductive ring 62 may be provided around the outer periphery of each vessel 60, and the connecting region 433 may abut each thermal conductive ring 62 under this circumstance.

The second conductive layer 45 of each temperature control device 40 may be made of a material having good electrical conductivity and thermal conductivity properties such as copper or the like. The second conductive layer 45 is formed on a part of the upper surface 411 of the substrate 41, as shown in FIG. 4. A part of the second conductive layer 45 surrounds each through hole 415 to define a ring portion 451 surrounding the outer periphery of the ring portion 439 of the first conductive layer 43. The second conductive layer 45 is spaced from the upper region 435 of the first conductive layer 43 at a predetermined distance, thus the second conductive layer 45 is not connected electrically with the first conductive layer 43.

Figure 5:
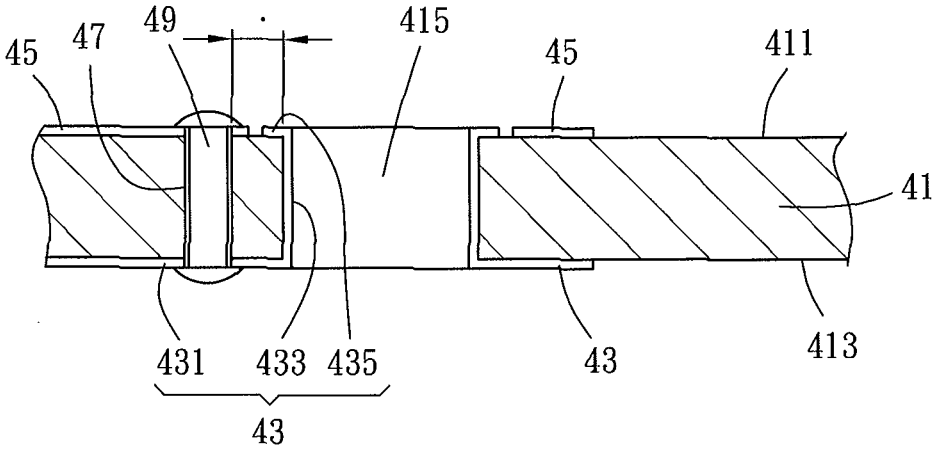
FIG. 5 is a cross-sectional view taken along line 5-5 of FIG. 4.

The receiving hole 47 of each temperature control device 40 is round cylindrical hole. As shown in FIG. 5, the receiving hole 47 extends through the substrate 41, the second conductive layer 45, and the lower region 431 of the first conductive layer 43, and is disposed adjacent to the through hole 415.

The heating element 49 of each temperature control device 40 is arranged in the receiving hole 47 and has two terminals. One of the terminals is connected electrically to the lower region 431 of the first conductive layer 43 and the other one is connected electrically to the second conductive layer 45. In this embodiment, the heating element 49 may be an electrical resistance heater and two terminals thereof are respectively connected electrically to the lower region 431 of the first conductive layer 43 and the second conductive layer 45 by tin soldering. However, in another embodiment, the type of the heating element 49 can be changed according to the actual need.

The elastic member 50 is disposed in the through groove 331 of the detection device 30 to press against each vessel 60 inserted through the through groove 331, such that each vessel 60 is able to abut reliably against the connecting region 433 of the first conductive layer 43 through the transverse force of the elastic member 50 thereby ensuring the thermal conductivity between the vessel 60 and the first conductive layer 43. The elastic member 50 may be made of rubber or any other elastic materials. Additionally, in alternate embodiment, in a condition that the outer periphery of the vessel 60 is configured to abut directly against the first conductive layer 43, the elastic member 50 can be omitted.

When the vessels 60 each containing biochemical reactants are inserted in the biochemical reactor 10 to perform a biochemical reaction, each one of the temperature control device 40 first supplies electricity to the heating element 49 by the first and the second conductive layers 43 and 45. The heating element 49 transforms the electrical energy into heat energy and then transfers the heat energy to the lower region 431, the connecting region 433, and the upper region 435 of the first conductive layer 43 to heat each vessel 60. An excellent thermal conductivity is then established between each vessel 60 and the heating element 49 for the reason that each vessel 60 abuts reliably against the connecting region 433 through the elasticity of the elastic member 50. Furthermore, because the receiving hole 47 is adjacent to the through hole 415, the heating element 49 is able to directly transfer the heat energy to the wall of the through hole 415 by the substrate 41, such that each vessel 60 can be heated by the heat energy from the heating element 49 and the connecting region 433. In addition, the heating element 49 also transfers the heat energy to the second conductive layer 45, such that a part of the substrate 41 adjacent to the through hole 415 can be heated by the ring portion 451. As such, the ring portion 451 can heat each vessel 60 by transferring the heat energy to not only the upper region 435 of the first conductive layer 43 but also the wall of the through hole 415. In a PCR system, for example, the upper region 64 and the lower region 66 of each vessel 60 can be maintained at a temperature ranging between 35° C. and 65° C. and at a temperature ranging between 90° C. and 97° C., respectively, by the two temperature control devices 40. In this manner, a temperature gradient descending from the bottom to the top of the biochemical solution in each vessel 60 can be established to induce a thermal convection so as to continuously perform the PCR. Meanwhile, the light-emitting elements 351 of the lighting circuit board 35 of the detection device 30 emit lights with specific wavelengths to the bottom 68 of each vessel 60 to excite the biochemical reactants in each vessel 60 to emit fluorescence. Different levels of fluorescence can be emitted from the biochemical reaction at different stages and the fluorescence thus emitted is detected by the sensors 323 of the detection plate 32, such that the progress of the biochemical reaction can be monitored by a user.

The above-mentioned construction can be varied based on the spirit of the present invention. For example, the second conductive layer 45 of each temperature control device 40 may not have the ring portion 451, such that the heat energy may be transferred to each vessel 60 only by the first conductive layer 43. Optionally, the first conductive layer 43 may not have the upper region 435, such that the heat energy may be transferred from the heating element 49 to each vessel 60 via the connecting region 433, the lower region 431, and the ring portion 451. Optionally, the lower region 431 of the first conductive layer 43 may not have the ring portion 437 but connects directly the connecting region 433, such that the heat energy may be transferred from the heating element 49 to the connecting region 433. According to a number of experimental tests, it is found that in order to have optimal heat conducting effect the distance d between the receiving hole 47 and the through hole 415 of the substrate 41 should be less than 1 cm, preferably less than 0.8 cm, more preferably less than 0.5 cm, and most preferably less than 0.3 cm. The distance d is defined by the shortest distance from the hole edge of the receiving hole 47 to the hole edge of the through hole 415. In other embodiment, the receiving hole 47 may have another profile.

Each unit of the biochemical reactor 10, such as the vessel holder 20, each element of the detection device 30, and the temperature control device 40, may have a plate-like shape. The biochemical reactor 10 may further comprise four bolts 18 passing through the aforesaid plate-shaped units, and have four nuts 19 adapted to engage those bolts 18 to combine the aforesaid plate-shaped units. Accordingly, the biochemical reactor 10 of the present invention can be assembled easily and disassembled conveniently for maintenance purpose. As a result, even though only one element such as the substrate 41 is broken, the biochemical reactor 10 can be repaired by simply disassembling the reactor and replacing the broken element with a new one. Additionally, the biochemical reactor 10 of the present invention is completely different from the conventional biochemical reactor having a bulky volume and a complicated construct for the following reasons: the biochemical reactor 10 of the present invention has a quite simple structure; the temperature control device 40, the detection plate 32 and the lighting circuit board 35 of the detection device 30 can be made by a known process of printed circuit board; and those plate-shaped units can be stacked one by one to reduce the total volume of the biochemical reactor 10.

Therefore, the biochemical reactor 10 of the present invention has a simple and lightweight configuration, has a simplified manufacturing process and a reduced manufacturing cost, and can be carried conveniently and used by a user.

The configuration of the biochemical reactor 10 may be varied according to the spirit of the present invention. The biochemical reactor 10, for instance, can be considered to be composed of two bodies and the temperature control device 40. A second body is spaced at a distance above a first body, the temperature control device 40 is disposed between the first and the second bodies, and the first and second bodies have first and second grooves, respectively. The first groove, the second groove, and the through hole 415 of the substrate 41 of the temperature control device 40 are communicated to each other to form a vessel receiving groove adapted for the insertion of the vessel 60. As an example, for the temperature control device 40 disposed between the vessel holder 20 and the top seat 31, the top seat 31, the detection plate 32, the bottom seat 33, the other temperature control device 40 located under the bottom seat 33, the base seat 34, and the lighting circuit board 35 are combinedly defined as the first body; the vertical groove 311, the through hole 321, the through groove 331, the through hole 415, and the tapered hole 341 are combinedly defined as the first groove; the vessel holder 20 is defined as the second body; and the vessel hole 22 is defined as the second groove. As another example, for the temperature control device 40 disposed between the bottom seat 33 and the base seat 34, the base seat 34 and the lighting circuit board 35 are combinedly defined as the first body; the tapered hole 341 is defined as the first groove; the bottom seat 33, the detection plate 32, the top seat 31, the other temperature control device 40 located above the top seat 31, and the vessel holder 20 are defined as the second body; the vessel hole 22, the through hole 415, the vertical groove 311, the through hole 321, and the through groove 331 are combinedly defined as the second groove. In fact, a heat dissipation device or a cooling device, for example, can be used as the first body and the second body located under and above the temperature control device 40, respectively, according to the actual need. In addition, the number of the temperature control device 40 of the biochemical reactor 10 may be one or more than two.

Figure 6:
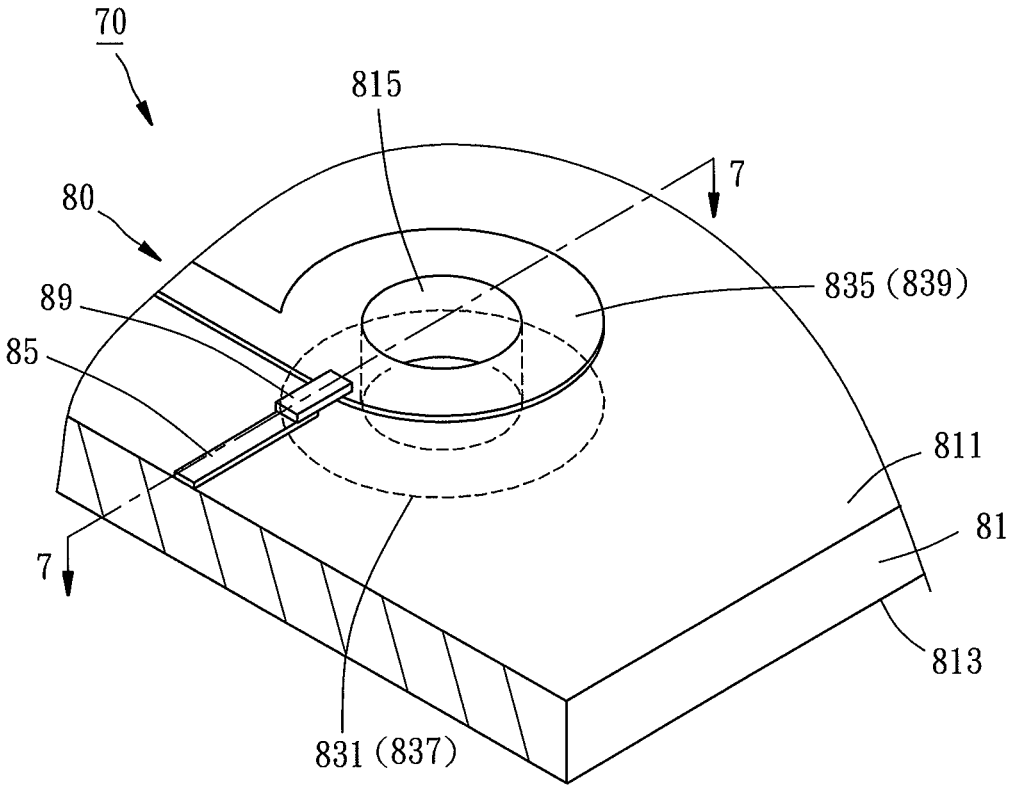
FIG. 6 is a perspective view of a part of a temperature control device of a second preferred embodiment of the present invention.

The temperature control device may have another configuration. For example, another biochemical reactor 70 according to a second preferred embodiment is shown in FIG. 6. The difference between the first and the second preferred embodiments lies in that the temperature control device 80 comprises a substrate 81, a first conductive layer 83, a second conductive layer 85, and a heating element 89. Because the temperature control device 80 is not provided with a receiving hole, it has a simpler structure than that of the temperature control device 40. The substrate 81 also has an upper surface 811, a lower surface 813 and four through holes 815.

The first conductive layer 83 also has an upper region 835 formed on a part of the upper surface 811 of the substrate 81 and surrounding the through hole 815 to define a ring portion 839, a connecting region 833, and a lower region 831 formed on the lower surface 813 of the substrate 81 and surrounding the through hole 815 to define a ring portion 837.

As shown in FIG. 6, the second conductive layer 85 is formed on a part of the upper surface 811 of the substrate 81 and is spaced apart from the upper region 835 of the first conductive layer 83 at a predetermined distance.

Figure 7:
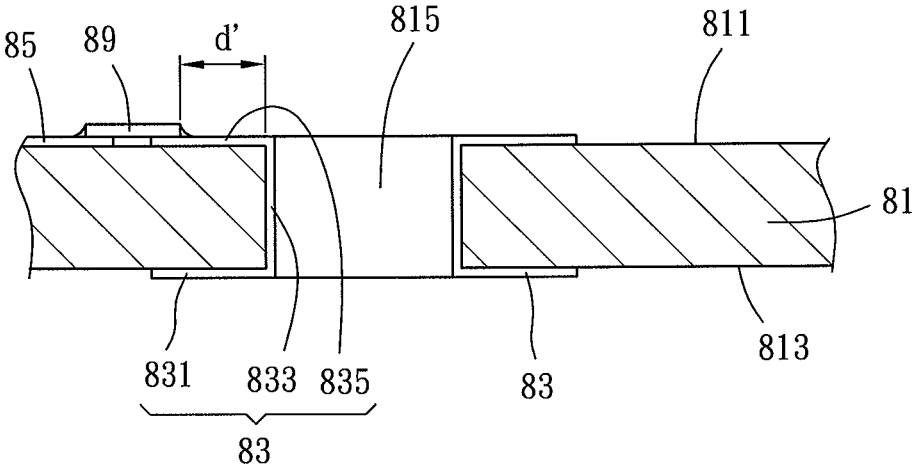
FIG. 7 is a cross-sectional view taken along line 7-7 of FIG. 6.

The heating element 89 of the temperature control device 80, as shown in FIG. 7, is disposed adjacent to the through hole 815 on the upper surface 811 of the substrate 81, and has two terminals respectively connected electrically to the upper region 835 of the first conductive layer 83 and the second conductive layer 85. In this manner, the heat generated from the heating element 89 can be transferred to each vessel 60 via the upper region 835, the connecting region 833, and the lower region 831 of the first conductive layer 83. As compared with the temperature control device 40 of the first preferred embodiment, because the substrate 81 is not provided with a receiving hole for receiving the heating element 89, the temperature control device 80 has a relatively simple structure, can be manufactured easily at reduced costs.

The above-mentioned construction can be varied based on the spirit of the present invention. For example, the first conductive layer 83 of each temperature control device 80 may not have the lower region 831, such that the heat energy generated from the heating element 89 may be transferred to each vessel 60 via the connecting region 833 and the upper region 835. Optionally, the upper region 835 of the first conductive layer 83 may not have the ring portion 839 but be connected directly between the heating element 89 and the connecting region 833, such that the heat energy may be transferred from the heating element 89 to the through hole 815. According to a number of experimental tests, it is found that in order to have optimal heat conducting effect, the distance d' between the heating element 89 and the through hole 815 of the substrate 81 should be less than 1 cm, preferably less than 0.8 cm, more preferably less than 0.5 cm, and most preferably less than 0.3 cm. The distance d' is defined by the shortest distance from the edge of the heating element 89 to the hole edge of the through hole 815. In other embodiment, the configuration and the type of the heating element 89 can be varied according to the actual need.

It should be understood that the detailed descriptions mentioned above, while indicating preferred embodiments of the invention, are given by way of illustration only, and thus are not limitative of the present invention. Such variations are not to be regarded as a departure from the spirit and scope of the invention, and all such modifications as would be obvious to one skilled in the art are intended to be included within the scope of the following claims. For example, the upper positions 435 and 835 and the lower positions 431 and 831 of the first conductive layers 43 and 83 and the second conductive layers 45 and 85 may have a different morphology. The temperature control devices 40 and 80 may have at least one through holes 415 and 815, and the amount of the through holes 415 and 815 can be changed. The biochemical reactor 10 may have at least one bolt 18 and one nut 19. The configuration of the vessel holder 20 may be modified or may not be provided depending on the circumstances.

What is claimed is:

1. A biochemical reactor adapted for insertion of a vessel, the biochemical reactor comprising:

a first body having a first groove;

a second body spaced at a distance above the first body and having a second groove; and a temperature control device including a substrate, a first conductive layer, a second conductive layer, a receiving hole, and a heating element; the substrate having an upper surface, a lower surface opposite to the upper surface, and a through hole extending through the upper surface and the lower surface; the first conductive layer having a lower region formed on a part of the lower surface of the substrate, and a connecting region formed on a wall of the through hole of the substrate and connected to the lower region; the second conductive layer being formed on a part of the upper surface of the substrate and not connected electrically to the first conductive layer; the receiving hole passing through the second conductive layer, the substrate and the lower region of the first conductive layer and being located adjacent to the through hole; and the heating element being disposed in the receiving hole and having two terminals respectively connected electrically to the lower region of the first conductive layer and the second conductive layer;

wherein the temperature control device is disposed between the first and second bodies in a way that the upper surface of the substrate faces upward or downward; and the first groove of the first body, the through hole of the substrate of the temperature control device, and the second groove of the second body are communicated with each other to form a vessel receiving groove for the insertion of the vessel.

2. The biochemical reactor as claimed in claim 1, wherein the second conductive layer has a ring portion surrounding the through hole of the substrate.

3. The biochemical reactor as claimed in claim 1, wherein the lower region of the first conductive layer has a ring portion surrounding the through hole of the substrate.

4. The biochemical reactor as claimed in claim 1, wherein the receiving hole of the temperature control device is spaced from the through hole of the substrate at a distance less than 1 cm.

5. The biochemical reactor as claimed in claim 1, wherein the first conductive layer further has an upper region formed on a part of the upper surface of the substrate, connected to the connecting region, and having a ring portion surrounding the through hole of the substrate.

6. The biochemical reactor as claimed in claim 1, wherein the connecting region of the first conductive layer of the temperature control device is adapted for abutting against an outer periphery of the vessel.

7. The biochemical reactor as claimed in claim 1, wherein the connecting region of the first conductive layer of the temperature control device is adapted for abutting against a thermal conductive ring provided around an outer periphery of the vessel.

8. A biochemical reactor adapted for insertion of a vessel, the biochemical reactor comprising:

a first body having a first groove;

a second body spaced at a distance above the first body and having a second groove; and a temperature control device including a substrate, a first conductive layer, a second conductive layer, and a heating element; the substrate having an upper surface, a lower surface opposite to the upper surface, and a through hole extending through the upper surface and the lower surface; the first conductive layer having an upper region formed on a part of the upper surface of the substrate, and a connecting region formed on a wall of the through hole of the substrate and connected to the upper region; the second conductive layer being formed on a part of the upper surface of the substrate and not connected electrically to the first conductive layer; and the heating element being disposed adjacent to the through hole on the upper surface of the substrate and having two terminals respectively connected electrically to the upper region of the first conductive layer and the second conductive layer;

wherein the temperature control device is disposed between the first and second bodies in a way that the upper surface of the substrate faces upward or downward; and the first groove of the first body, the through hole of the substrate of the temperature control device, and the second groove of the second body are communicated with each other to form a vessel receiving groove for the insertion of the vessel.

9. The biochemical reactor as claimed in claim 8, wherein the upper region of the first conductive layer has a ring portion surrounding the through hole of the substrate.

10. The biochemical reactor as claimed in claim 8, wherein the heating element is spaced from the through hole of the substrate at a distance less than 1 cm.

11. The biochemical reactor as claimed in claim 8, wherein the first conductive layer further has a lower region formed on a part of the lower surface of the substrate, connected to the connecting region, and having a ring portion surrounding the through hole of the substrate.

12. The biochemical reactor as claimed in claim 8, wherein the connecting region of the first conductive layer of the temperature control device is adapted for abutting against an outer periphery of the vessel.

13. The biochemical reactor as claimed in claim 8, wherein the connecting region of the first conductive layer of the temperature control device is adapted for abutting against a thermal conductive ring provided around an outer periphery of the vessel.

* * * * *